US011751731B2

(12) United States Patent
Brown

(10) Patent No.: US 11,751,731 B2
(45) Date of Patent: Sep. 12, 2023

(54) STABILIZED TOILET SEAT AND TOILET BOWL

(71) Applicant: Leonard C Brown, Columbus, MS (US)

(72) Inventor: Leonard C Brown, Columbus, MS (US)

( * ) Notice: Subject to any disclaimer, the term of this patent is extended or adjusted under 35 U.S.C. 154(b) by 161 days.

(21) Appl. No.: 17/466,796

(22) Filed: Sep. 3, 2021

(65) Prior Publication Data

US 2023/0070424 A1 Mar. 9, 2023

(51) Int. Cl.
*A47K 13/24* (2006.01)

(52) U.S. Cl.
CPC ..... *A47K 13/242* (2013.01)

(58) Field of Classification Search
CPC ..... A47K 13/242; A47K 13/26
See application file for complete search history.

(56) References Cited

U.S. PATENT DOCUMENTS 1,588,019 A 6/1926 Gitter
1,697,973 A * 1/1929 Fisher ..... A47K 13/26 4/234
4,296,504 A 10/1981 Lawson
4,893,360 A * 1/1990 Wofford ..... A47K 13/26 297/188.1
5,091,999 A * 3/1992 Turner, Jr. ..... A47K 13/26 4/237
5,212,840 A 5/1993 Caldwell
5,361,425 A 11/1994 Armanno
9,265,390 B2 2/2016 Dillard
10,499,775 B1 12/2019 Ramos
2015/0020301 A1* 1/2015 Moore ..... B32B 38/0036 156/60
2017/0181588 A1 6/2017 Holder

* cited by examiner

*Primary Examiner* — J C Jacyna
(74) *Attorney, Agent, or Firm* — The Keys Law Firm PLLC

(57) ABSTRACT

A stabilized toilet seat and toilet bowl that operates to prevent the toilet seat, when placed in a parallel orientation relative to the rim of a toilet bowl, from moving laterally or diagonally. The stabilized toilet seat and toilet bowl includes an interlocking system integral with both the toilet seat and the toilet bowl which automatically engages whenever the toilet seat is hinged into the parallel orientation without placing any restriction on the toilet seat's hinging movement into or out of the parallel orientation. A locking protrusion integral with the toilet seat and a locking slot integral with the toilet bowl may form the interlocking system.

10 Claims, 4 Drawing Sheets

STABILIZED TOILET SEAT AND TOILET BOWL

BACKGROUND OF THE INVENTION

Field of the Invention

This invention relates generally to toilet seating and, more particularly, to a combined toilet seat and toilet bowl having an integrated stabilizing system.

Description of the Prior Art

The use and design of toilets as sanitary hardware is well known. Most toilets include at minimum some sort of a receptacle portion, such as a bowl for receiving temporarily holding user waste and subsequently allowing it to be directed therefrom to a desired disposal location. Toilets may also include additional items integrated with the bowl which facilitate functionality, such as a cistern and drain system, or a vacuum.

In addition, many toilets are constructed so that they can be used by a user while either standing and facing the toilet or while seated and facing away from the user. In this regard, toilets typically have a commonly include a toilet seat hingedly attached on one side above the toilet bowl and which can alternatively be laid parallel with the rim of the toilet bowl for a seated user and stood perpendicular to the rim of the toilet bowl when the toilet is being used by a standing user. But because a toilet seat is only attached on one side of the toilet bowl and it must remain light enough to be able to move freely between its parallel and perpendicular a problem which exists is that it can often be easily dislodged by a user. Particularly when a user is sitting down or attempting to get up, lateral or diagonal movement on the toilet seat has a tendency to loosen or degrade the hinged attachment of the toilet seat to the toilet bowl. And in instances where the hinged attachment breaks, a user could easily fall to the ground and injure themselves because a person would commonly be somewhat off balance during such position transistors (i.e., sitting down or attempting to get up).

As such, there remains a need for a toilet seat and toilet bowl having an integrated stabilizing system that effectively reduces lateral and diagonal movement of a toilet seat when it is in a parallel position relative to the rim of the toilet bowl. It would be advantageous if such a stabilized toilet seat and toilet bowl employed a locking protrusion and corresponding locking slot positioned to automatically engage whenever the toilet seat was placed in a parallel position relative to the rim of the toilet bowl. It would additionally be desirable for the locking protrusion and corresponding locking slot to be shaped so as to never obstruct or restrict the normal hinging movement of the toilet seat.

SUMMARY OF THE INVENTION

The present disclosure provides for a stabilized toilet seat and toilet bowl, comprising: a toilet bowl having a rim with a planar top surface; a toilet seat having a distal end and a substantially planar bottom surface, wherein the distal end of the toilet seat is hingedly attached to the toilet bowl such that the toilet seat is selectably moveable between a parallel orientation in which a plane which defines the bottom surface and a plane which defines the top surface of the rim are parallel and a perpendicular orientation in which the plane which defines the bottom surface and the plane which defines the top surface of the rim are perpendicular; and an interlocking system integral with both the toilet seat and the toilet bowl, wherein the interlocking system is configured to prevent the toilet seat from moving in any direction other than towards the perpendicular orientation whenever the toilet seat is placed in the parallel orientation. The interlocking system may be embodied as a locking protrusion and a locking slot.

DETAILED DESCRIPTION OF THE INVENTION

Figure 1:
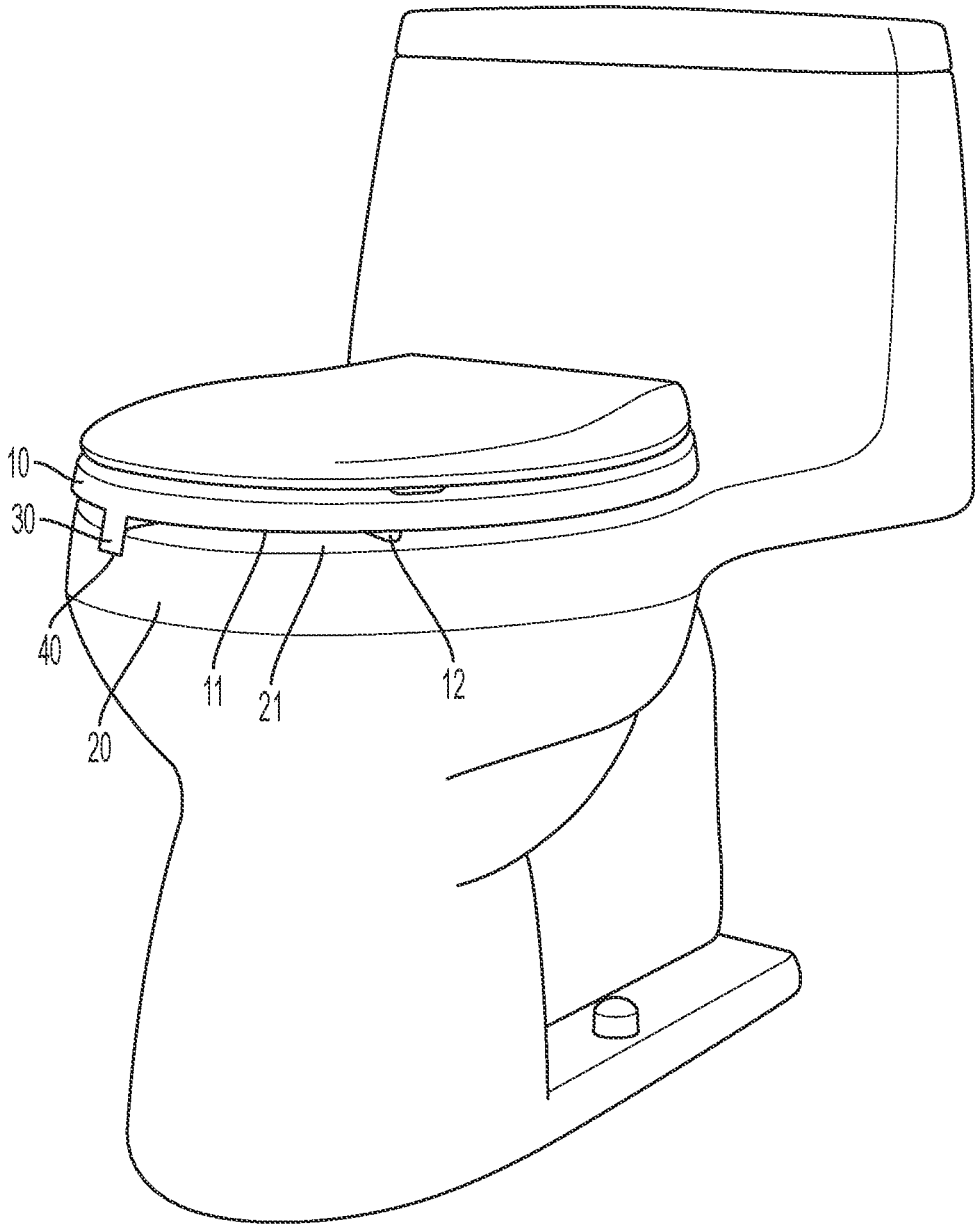
FIG. 1 is a side perspective view of a flush toilet apparatus having a stabilized toilet seat and toilet bowl built in accordance with the present invention.

Described herein is a stabilized toilet seat and toilet bowl that operates to prevent the toilet seat, when placed in a parallel orientation relative to the rim of a toilet bowl, from moving laterally or diagonally, thereby only allowing it to move in a direction towards a perpendicular orientation. The stabilized toilet seat and toilet bowl includes an interlocking system which automatically engages whenever the toilet seat is hinged into the parallel orientation without placing any restriction on the toilet seat's hinging movement into or out of the parallel orientation.

Referring now to the drawings and, in particular, FIGS. 1, 2, 3, 4, and 5, a stabilized toilet seat and toilet bowl built in accordance with the present invention is embodied in a toilet seat 10, a toilet bowl 20, and an interlocking system. Both the toilet seat and toilet bowl may be conventionally sized and constructed of conventional materials, such as plastic and porcelain, respectively. The toilet bowl 20 may include a rim 21 having a substantially planar top surface and the toilet seat 10 may include a principally planar bottom surface 11 having disposed thereon include a plurality of spacers 12 which extend downwardly therefrom.

Figure 2:
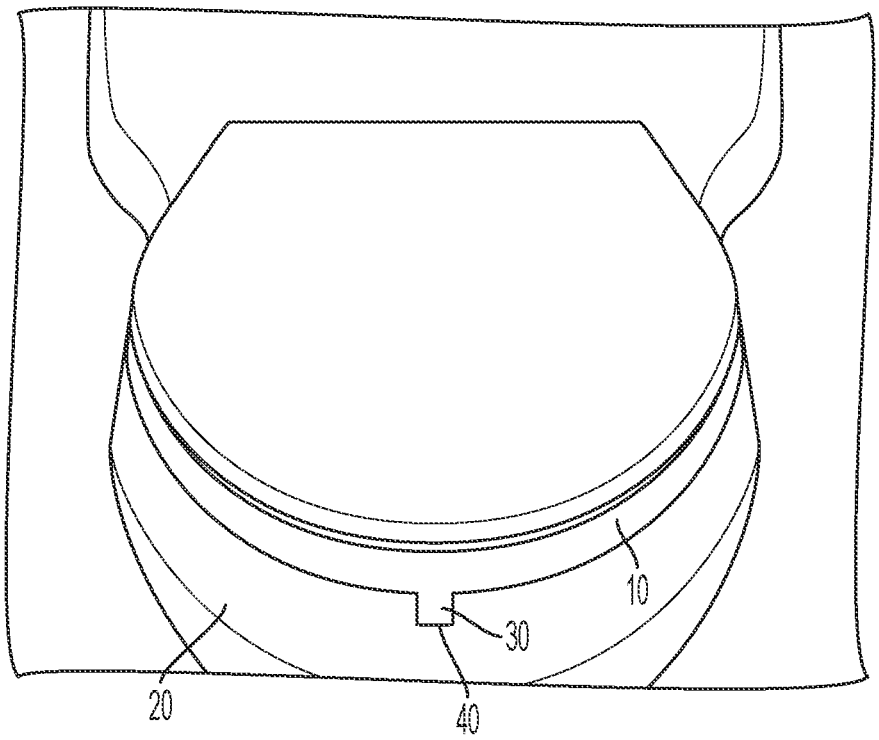
FIG. 2 is a front perspective view of a flush toilet apparatus having a stabilized toilet seat and toilet bowl built in accordance with the present invention.
Figure 3:
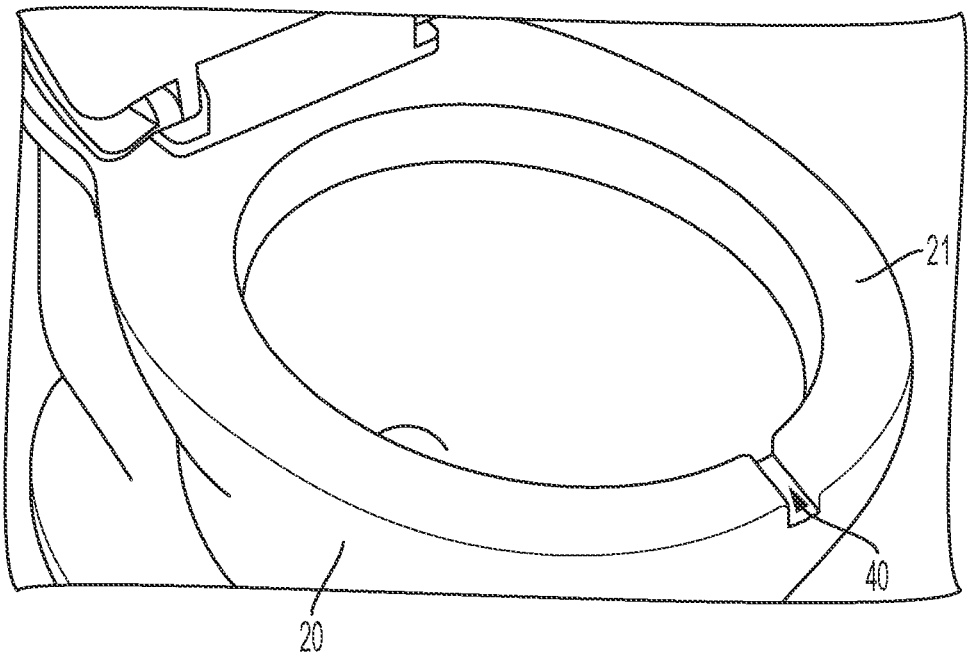
FIG. 3 is a side perspective view of a toilet bowl built in accordance with the present invention.

The toilet seat 10 may additionally include a pair of hinges 13 which are positioned on its distal end 14 and which enable it to be attached to apertures (not shown) the rim 21 of the toilet bowl 20. As illustrated in FIGS. 1 and 2, the toilet seat 10 may be hinged into a parallel orientation in which the bottom surface 11 faces the rim 21, with the plane which defines the bottom surface 11 and the plane which defines the rim 21 parallel to one another. As illustrated in FIG. 3, the toilet seat 10 may also be hinged into a perpendicular orientation in which the plane which defines the bottom surface 11 and the plane which defines the rim 21 are perpendicular, or at least intersecting.

The interlocking system includes a locking protrusion 30 and a corresponding locking slot 40, with one of the locking protrusion 30 and the corresponding locking slot 40 each being integral with the toilet seat 10 and the other being integral with the toilet bowl 20. The locking protrusion 30 and locking slot 40 may be positioned on the toilet seat 10 and the toilet bowl 20 such that when the toilet seat 10 is in the parallel orientation, the locking protrusion 30 inserts into and engages the locking slot 40.

Figure 5:
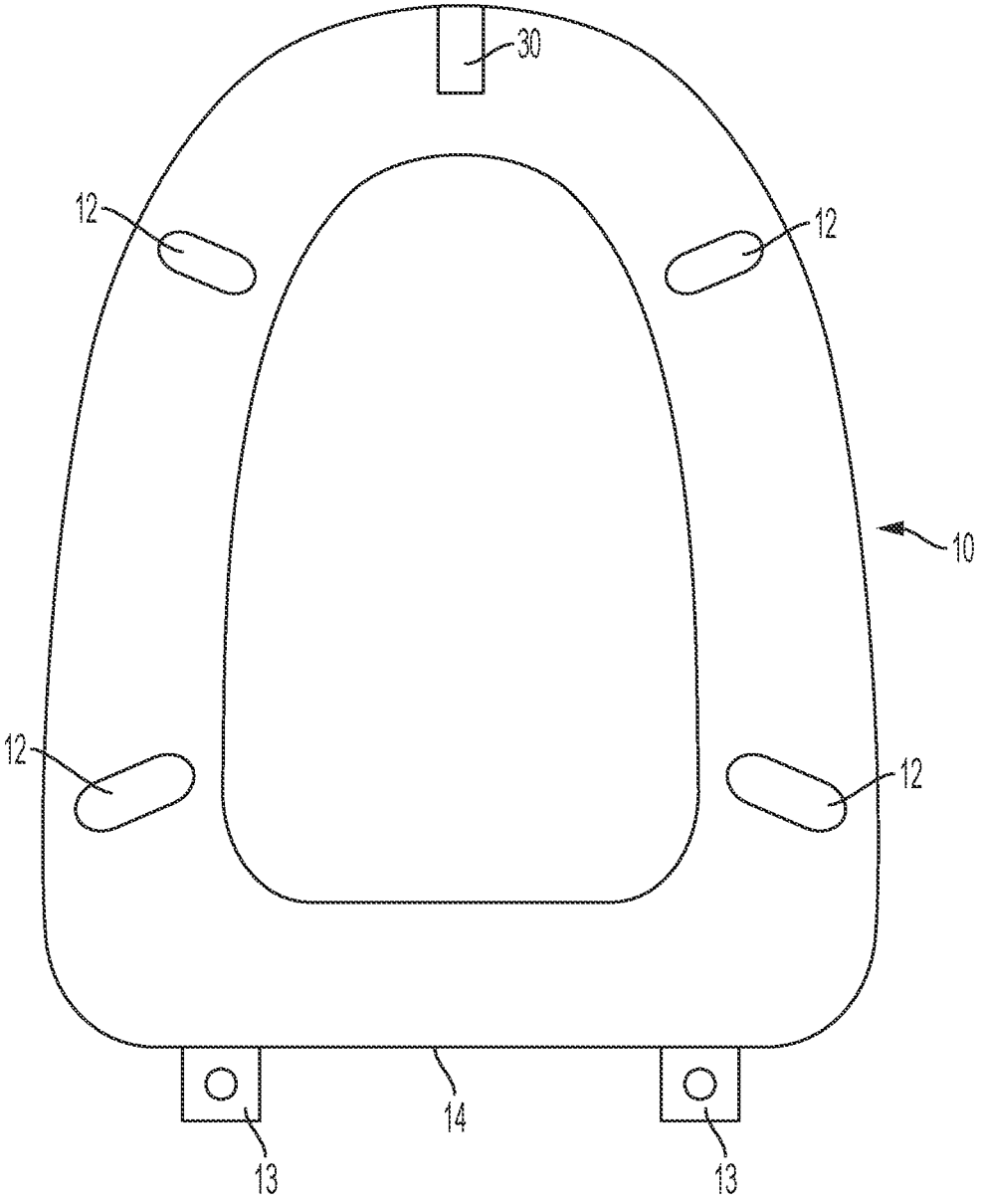
FIG. 5 is a bottom plan view of a toilet seat built in accordance with the present invention.

The locking protrusion 30 may be defined by a rigid body which extends downward from the bottom surface 11 and is positioned on the proximal end of the toilet seat 10 which is opposite the distal end 14 where the hinges 13 are disposed. The locking protrusion 30 may be shaped as a rectangular prism which is elongated, or as a cube. In embodiments wherein the locking protrusion 30 is elongated, it is contemplated that its length will extend from the edge of the proximal end of the bottom surface 11 across the bottom surface 11 towards the distal end 14. In such embodiments, it is further contemplated that the locking protrusion 30 may extend completely across one portion of the bottom surface 11 or it may only extend partially across the bottom surface 11, as shown in FIG. 5.

The locking slot 40 may be defined by an elongated, rectangular prism shaped recess (or channel) in the rim 21. The locking slot 40 may extend completely across one portion of the rim 21, as shown in FIG. 3, or it may only extend partially across the rim 21. It is contemplated that the locking slot 40 may be sized, shaped, and oriented to correspond to the locking protrusion 30 so that when the toilet seat 10 is placed in the parallel orientation, the locking protrusion 30 slidably inserts into the locking slot 40 with a sufficiently snug engagement that the locking protrusion 30 cannot move laterally while in the locking slot 40. In this regard, the locking slot 40 may be positioned on the portion of the rim 21 that is opposite to where the hinges 13 are coupled to the rim 21.

Figure 4:
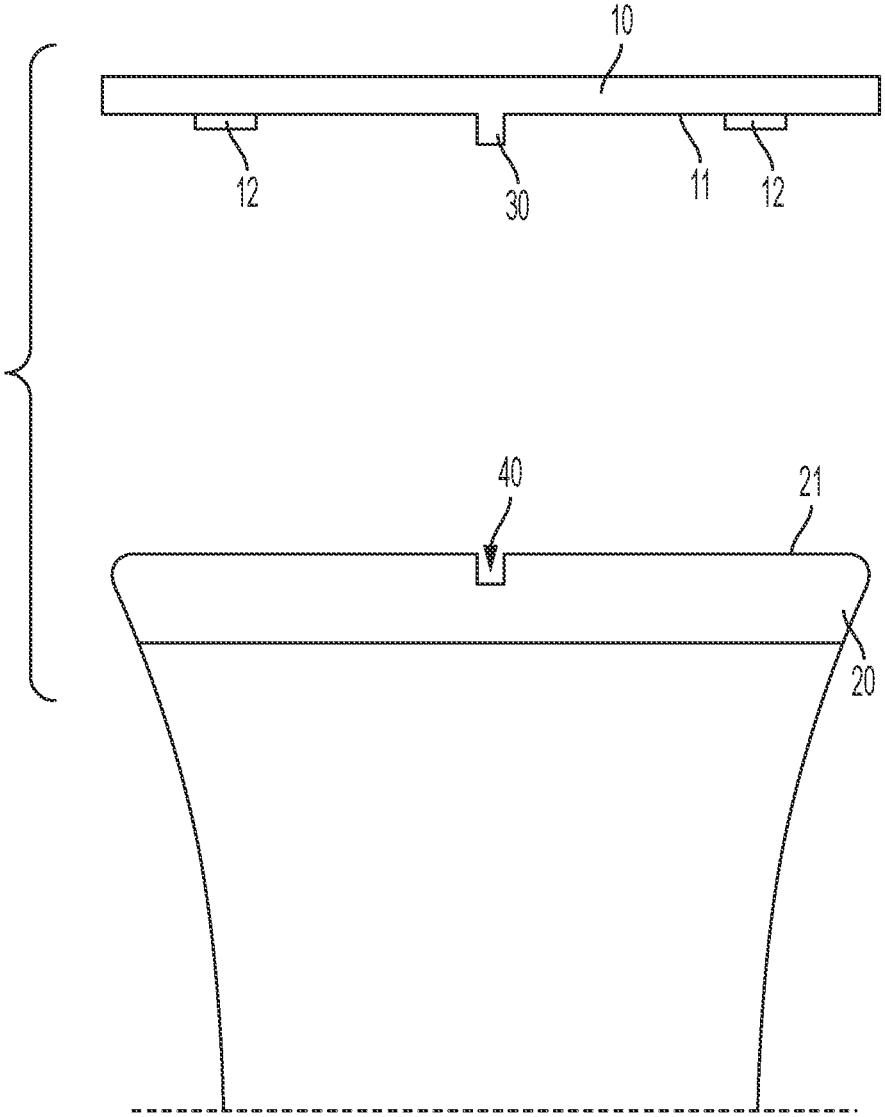
FIG. 4 is an exploded front elevational view of both a toilet seat and toilet bowl built in accordance with the present invention.

It is contemplated that the locking protrusion 30 will extend down further than any spacers 12, as shown in FIG. 4, as the spacers are intended to merely rest on the rim 21 while the locking protrusion must go beyond the upper surface of the rim into the locking slot 40.

It is contemplated that in some embodiments, the locking protrusion may be deformable or elastic and be suited to frictionally engage the locking slot.

In some embodiments of the present invention, the locking protrusion may be disposed on the rim, with the locking slot on the bottom surface of the toilet seat.

In some embodiments of the present invention, the locking slot or the locking protrusion may include on its surface rubber or another shock absorptive material.

In some embodiments of the present invention, the interlocking system may include a plurality of locking protrusions, some of which may be integrated with the spacers on a toilet seat or otherwise arranged in an angular positioned around the toilet seat, along with a plurality of corresponding locking slots.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A stabilized toilet seat and toilet bowl apparatus, comprising:

a toilet bowl having a rim with a planar top surface;

a toilet seat having a distal end and a substantially planar bottom surface, wherein the distal end of the toilet seat is hingedly attached to the toilet bowl such that the toilet seat is selectably moveable between a parallel orientation in which a plane which defines the bottom surface and a plane which defines the top surface of the rim are parallel and a perpendicular orientation in which the plane which defines the bottom surface and the plane which defines the top surface of the rim are perpendicular;

a locking protrusion integral with the toilet seat and oriented to extend outwardly from the bottom surface, wherein the locking protrusion is elongated;

a locking slot forming an elongated recess in the rim, wherein the locking slot is size, oriented and positioned to correspond to the locking protrusion such that when the toilet seat is placed in the parallel orientation, at least a portion of the locking protrusion is positioned in the locking slot;

wherein when the at least a portion of the locking protrusion is present in the locking slot, the positioning of the locking protrusion operates to prevent the toilet seat from moving in any direction other than towards the perpendicular orientation;

wherein the elongated recess in the rim formed by the locking slot extends completely across a portion of the rim; and wherein the locking protrusion is integral with the toilet seat at a proximal end of the toilet seat that is opposite the distal end and the locking slot is integral with the toilet bowl at an end of the toilet bowl opposite the end of the bowl where the toilet seat attaches to the toilet bowl.

2. The stabilized toilet seat and toilet bowl apparatus of claim 1, wherein the locking protrusion is positioned to extend from an edge at the proximal end of the toilet seat that is furthest from the distal end and to extend in a direction that is orthogonal to the distal end.

3. The stabilized toilet seat and toilet bowl apparatus of claim 1, wherein the locking protrusion is positioned to extend from an edge at the proximal end of the toilet seat that is furthest from the distal end and to extend in a direction that is orthogonal to the distal end.

4. The stabilized toilet seat and toilet bowl apparatus of claim 1, wherein the toilet seat additionally includes a plurality of spacers which each extend outwardly from the bottom surface.

5. The stabilized toilet seat and toilet bowl apparatus of claim 4, wherein the locking protrusion extends outwardly from the bottom surface further than each of the plurality of spacers.

6. The stabilized toilet seat and toilet bowl apparatus of claim 1, wherein the locking protrusion is rigid.

7. A stabilized toilet seat and toilet bowl apparatus, comprising:

a toilet bowl having a rim with a planar top surface;

a toilet seat having a distal end and a substantially planar bottom surface, wherein the distal end of the toilet seat is hingedly attached to the toilet bowl such that the toilet seat is selectably moveable between a parallel orientation in which a plane which defines the bottom surface and a plane which defines the top surface of the rim are parallel and a perpendicular orientation in which the plane which defines the bottom surface and the plane which defines the top surface of the rim are perpendicular;

a rigid locking protrusion integral with the toilet seat and oriented to extend outwardly from the bottom surface, wherein the locking protrusion is elongated;

a locking slot forming an elongated recess in the rim, wherein the locking slot is size, oriented and positioned to correspond to the locking protrusion such that when the toilet seat is placed in the parallel orientation, at least a portion of the locking protrusion is positioned in the locking slot;

wherein when the at least a portion of the locking protrusion is present in the locking slot, the positioning of the locking protrusion operates to prevent the toilet seat from moving in any direction other than towards the perpendicular orientation;

wherein the toilet seat additionally includes a plurality of spacers which each extend outwardly from the bottom surface and the locking protrusion extends outwardly from the bottom surface further than each of the plurality of spacers;

wherein the elongated recess in the rim formed by the locking slot extends completely across a portion of the rim; and wherein the locking protrusion is integral with the toilet seat at a proximal end of the toilet seat that is opposite the distal end and the locking slot is integral with the toilet bowl at an end of the toilet bowl opposite the end of the bowl where the toilet seat attaches to the toilet bowl.

8. The stabilized toilet seat and toilet bowl apparatus of claim 7, wherein the locking protrusion is positioned to extend from an edge at the proximal end of the toilet seat that is furthest from the distal end and to extend in a direction that is orthogonal to the distal end.

9. The stabilized toilet seat and toilet bowl apparatus of claim 7, wherein the locking protrusion is elongated and integral with the toilet seat at a proximal end of the toilet seat that is opposite the distal end and the locking slot is integral with the toilet bowl at an end of the toilet bowl opposite the end of the bowl where the toilet seat attaches to the toilet bowl.

10. The stabilized toilet seat and toilet bowl apparatus of claim 9, wherein the locking protrusion is positioned to extend from an edge at the proximal end of the toilet seat that is furthest from the distal end and to extend in a direction that is orthogonal to the distal end.

* * * * *